US005525870A

United States Patent [19]

Matsuzawa et al.

[11] Patent Number: 5,525,870

[45] Date of Patent: Jun. 11, 1996

[54] CONTROL APPARATUS OF FLUORESCENT LAMP

[75] Inventors: Shigeo Matsuzawa, Ooizumi-machi; Mitsuru Kakinuma, Sakai-machi, all of Japan

[73] Assignee: Sanyo Electric Co., Ltd., Osaka, Japan

[21] Appl. No.: 378,877

[22] Filed: Jan. 25, 1995

Related U.S. Application Data

[63] Continuation of Ser. No. 76,397, Jun. 14, 1993, abandoned.

[30] Foreign Application Priority Data

Jun. 30, 1992 [JP] Japan ..... 4-173109

[51] Int. Cl.[6] ..... H05B 37/02

[52] U.S. Cl. ..... 315/209 R; 315/DIG. 5; 315/307; 315/127; 315/225

[58] Field of Search ..... 315/127, 225, 315/209 R, DIG. 5, 307, 86; 361/18

[56] References Cited

U.S. PATENT DOCUMENTS

| | | | |
|---|---|---|---|
| 4,060,752 | 11/1977 | Walker | 315/307 |
| 4,251,752 | 2/1981 | Stolz | 315/DIG. 7 |
| 4,873,471 | 10/1989 | Dean et al. . | |
| 4,952,849 | 8/1990 | Fellows et al. . | |
| 5,015,919 | 5/1991 | Vila-Mosot et al. | 315/127 |
| 5,097,181 | 3/1992 | Kakitani | 315/204 R |
| 5,142,202 | 8/1992 | Sun et al. | 315/225 |

FOREIGN PATENT DOCUMENTS

| | | | |
|---|---|---|---|
| 0062275 | 3/1982 | European Pat. Off. . | |
| 0146683 | 7/1982 | European Pat. Off. . | |
| 3263796 | 11/1991 | Japan | 313/209 R |
| 2224170 | 4/1990 | United Kingdom . | |

*Primary Examiner*—Robert Pascal
*Assistant Examiner*—Darius Gambino
*Attorney, Agent, or Firm*—Darby & Darby

[57] ABSTRACT

A control apparatus for a fluorescent lamp for detecting an end-of-life state of a fluorescent lamp for making it possible to take suitable countermeasures. In the control apparatus, a load circuit is formed of a capacitor connected between filaments of a fluorescent lamp and a choke coil connected in series with the filament, and there are provided a detection coil for detecting a tube current flowing through the load circuit and a detection circuit receiving an output voltage of a rectifier circuit rectifying the output of the detection coil for detecting a rise in the output voltage occurring when the output frequency of an oscillation circuit is modulated by a modulation circuit.

5 Claims, 5 Drawing Sheets

CONTROL APPARATUS OF FLUORESCENT LAMP

This is a continuation of application Ser. No. 08/076,397, filed Jun. 14, 1993, now abandoned.

BACKGROUND OF THE INVENTION

The present invention relates to a control apparatus for a fluorescent lamp having an oscillation circuit for lighting control of a fluorescent lamp in accordance with the output frequency of the oscillation circuit.

The fluorescent lamp hitherto in use has filaments disposed on its both ends and has a load circuit formed of the fluorescent lamp with the filaments, a capacitor connected between the filaments, and a choke coil connected in series with the filament. When a voltage of a predetermined frequency according to the output frequency of the oscillation circuit is applied to the load circuit the filaments are preheated so that a discharge is passed between the filaments and light is emitted.

FIG. 2 shows the relationship between the output frequency f of the oscillation circuit and the tube current I flowing through the load circuit (f-I characteristic). When the fluorescent lamp is normally lighted, the relationship between the output frequency f and the tube current I has a virtually linear characteristic as indicated by a in FIG. 2, namely the tube current I decrease as the output frequency f increases. However, when no discharge takes place between the filaments, the capacitor, choke coil, and the resistance of the filaments come to be connected in series, and, hence, the f-I characteristic indicated by b in FIG. 2, is such that the current reaches a maximum at the resonant frequency f0.

The oscillation circuit, in the normal state, operates to light the fluorescent lamp at a fundamental frequency f1 (period: T1) of the value which is different from the resonant frequency f0. However, when the fluorescent light is extinguished on the lamp is exchanged, in order to pass a large tube current through the load circuit so that the fluorescent lamp is automatically lit again, it is arranged in the modulation circuit such that the output frequency f is modulated to a frequency f2 closer to the resonant frequency f0 than the fundamental frequency f1 at intervals of a predetermined period T3 (for example 4 msec) as shown in FIG. 3. By execution of such modulation, when the fluorescent lamp is in its lighted state, the tube current I becomes smaller during the execution of the modulation as shown in FIG. 4. However, when the lamp is in its extinguished state, the tube current I becomes greater as shown in FIG. 5. By the greater tube current I provided at this time, the filaments are preheated and a discharge is caused to take place, so that the fluorescent lamp automatically starts to emit light again.

However, since the preheating current flows through the filament as described above, the filament undergoes aged deterioration, i.e., it gradually sublimes and becomes thinner, and it eventually leads to defective lighting of the fluorescent lamp. At such an end of life of the fluorescent lamp, a current still flows through the load circuit because the filament is not yet broken. Nevertheless, the lamp becomes unable to come on again even if the above described modulation is performed, or, even when it is turned on, it immediately goes out. This produces a large tube current flowing through the fluorescent lamp every time the modulation is performed. If such a condition lasts long, an abnormal temperature rise is caused in the choke coil or an unpleasant state for lighting apparatus occurs such that the fluorescent lamp at the end of life repeatedly goes on and out. Such a problem becomes more severe when the fluorescent lamp is being dimmed.

Especially when a large number of fluorescent lamps are being lit, if one of the fluorescent lamps reaches its end of life, all the fluorescent lamps must be put out for the protection of the circuit, or if it is desired to put out only the fluorescent lamp reaching its end of life, a problem arises in that a detection circuit must be provided for each of the fluorescent lamps.

There has also been such a problem that, when the power supply voltage becomes low for some reason or other and the voltage applied to the oscillation circuit is thereby lowered, operation of the oscillating circuit becomes unstable and an abnormal oscillating operation is made.

SUMMARY OF THE INVENTION

The present invention was made to solve the above problems in the prior art and it is an object of the present invention to provide a control apparatus of fluorescent lamp with which it is made possible to detect an end-of-life state of a fluorescent lamp and take suitable countermeasures.

In order to achieve the above mentioned object of the invention, there is provided a control apparatus for a fluorescent lamp having a load circuit formed of a fluorescent lamp provided with filaments at both ends thereof, a capacitor connected between the filaments, and a choke coil connected in series with the filament, an oscillation circuit, an output circuit for applying the load circuit with a voltage at a frequency based on an output frequency of the oscillation circuit, and a modulation circuit for modulating the output frequency of the oscillation circuit to a frequency around the resonant frequency of the load circuit at a predetermined period. The control apparatus of fluorescent lamp has a tube end-of-life detection circuit, constituted of current detection means for detecting a tube current flowing through the load circuit, a rectifier circuit for rectifying the output of the current detection means, and a detection circuit receiving the output voltage of the rectifier circuit for detecting a rise in the output voltage during the modulation of the output frequency of the oscillation circuit performed by the modulation circuit.

Even if the output frequency of the oscillation circuit is modulated by the modulation circuit to a frequency around the resonant frequency, the tube current becomes smaller, as shown in FIG. 4, when the fluorescent lamp is normally lit. But the tube current conversely becomes greater as shown in FIG. 5, when the fluorescent lamp is put out and, thereby, the filaments are preheated to pass a discharge. When a fluorescent lamp age-deteriorates and, thereby, such a state where the fluorescent lamp does not go on even if the greater current is passed through the load circuit upon execution of the modulation or the fluorescent lamp immediately goes out even if it is lit is brought about and the condition shown in FIG. 5 lasts long.

According to the control apparatus of fluorescent lamp of the present invention, the tube current flowing through the load circuit is detected by the current detection means in the tube's end-of-life detection circuit and the rectifier circuit rectifies the detected current and supplies the rectified current to the detection circuit. The detection circuit detects a rise in the output voltage of the rectifier circuit and detects the high current produced upon execution of the above modulation. If the high tube current flow produced during the modulation can be detected, the end-of-life state of a fluorescent lamp can be detected when the high current is continually detected for example over a predetermined period of time, and thus it becomes possible to take suitable countermeasures.

Further, a control apparatus for a fluorescent lamp of the present invention is arranged to have a load circuit formed of a fluorescent lamp provided with filaments at both ends thereof, a capacitor connected between the filaments, and a choke coil connected in series with the filament, an oscillation circuit, an output circuit for applying the load circuit with a voltage at a frequency based on an output frequency of the oscillation circuit, and a modulation circuit for modulating the output frequency of the oscillation circuit to a frequency around the resonant frequency of the load circuit at a predetermined period. The control apparatus of fluorescent lamp has a tube end-of-life detection circuit, formed of current detection means for detecting a tube current flowing through the load circuit, a rectifier circuit for rectifying the output of the current detection means, and a detection circuit receiving the output voltage of the rectifier circuit for detecting a rise in the output voltage during the modulation of the output frequency of the oscillation circuit performed by the modulation circuit and prohibiting the frequency modulating operation of the modulation circuit when the rise of the output voltage has continued for a predetermined period of time.

According to the control apparatus of fluorescent lamp of the present invention, since the detection circuit in the tube's end-of-life detection circuit prohibits the frequency modulating operation performed by the modulating circuit upon detection of the tube's end-of-life state, the high tube current is prevented from flowing and the fluorescent lamp reaching its end of life is not allowed to go on again and remains extinguished and, thus, the deterioration in the illuminating effect caused by the fluorescent lamp repeatedly going on and off is prevented.

Further, a control apparatus of fluorescent lamp of the present invention is arranged to have a load circuit formed of a fluorescent lamp provided with filaments at both ends thereof, a capacitor connected between the filaments, and a choke coil connected in series with the filament, an oscillation circuit, an output circuit for applying the load circuit with a voltage at a frequency based on an output frequency of the oscillation circuit, a modulation circuit for modulating the output frequency of the oscillation circuit to a frequency around the resonant frequency of the load circuit at a predetermined period, and a dimmer circuit adjusting the output frequency of the oscillation circuit for dimming the fluorescent lamp. The control apparatus of the fluorescent lamp has a tube end-of-life detection circuit, formed of current detection means for detecting a tube current flowing through the load circuit, a rectifier circuit for rectifying the output of the current detection means, and a detection circuit receiving the output voltage of the rectifier circuit for detecting a rise in the output voltage during the modulation of the output frequency of the oscillation circuit performed by the modulation circuit and prohibiting the frequency modulating operation of the modulation circuit and the dimming operation of the dimmer circuit when the rise of the output voltage has continued a predetermined period of time.

According to the control apparatus of fluorescent lamp of the present invention, since the detection circuit in the tube's end-of-life detection circuit prohibits the frequency modulating operation performed by the modulating circuit and the dimming operation performed by the dimmer circuit upon detection of the tube's end-of-life state, the high tube current produced upon execution of the modulation and dimming is prevented from flowing.

Further, a control apparatus for a fluorescent lamp of the present invention is arranged to have a first and a second load circuit formed of a first and a second fluorescent lamp, respectively provided with filaments at both ends of each thereof, and a capacitor connected between the filaments as well as a choke coil connected in series with the filament of each fluorescent lamp, an oscillation circuit, an output circuit for applying each of the load circuits with a voltage at a frequency based on an output frequency of the oscillation circuit, and a modulation circuit for modulating the output frequency of the oscillation circuit to a frequency around the resonant frequency of the load circuit at a predetermined period. The control apparatus of the fluorescent lamp has a tube end-of-life detection circuit, formed of first and second current detection means for detecting a tube current flowing through each of the load circuits, a rectifier circuit for rectifying the sum of the outputs of the current detection means, the outputs being arranged to be of characteristics reverse to each other, and a detection circuit receiving the output voltage of the rectifier circuit for detecting a rise in the output voltage during the modulation of the output frequency of the oscillation circuit performed by the modulation circuit.

In the control apparatus of fluorescent lamp of the present invention, since the tube currents flowing through both of the load circuits are considered the same when both fluorescent lamps are normally lit, they cancel each other when added, by arranging them to have reverse characteristics and, hence, no output voltage is provided from the rectifier circuit. When either of the fluorescent lamps reaches its end of life and the great current is passed upon execution of the modulation, the above canceling state is stopped and the output voltage of the rectifier circuit rises. The detection circuit detects this rise in the output voltage of the rectifier circuit. If this can be detected, then, by determining that the same condition is detected continually for example over a predetermined period, it can be judged that either of the fluorescent lamps has reached its end of life and it is thereby made possible to take suitable countermeasure. Since the tube current becomes greater especially when a large number of fluorescent lamps are lit, sometimes it becomes difficult, with the earlier described invention, to distinguish such current from that current produced when a fluorescent lamp has reached its end of life, but according to the last mentioned invention, it is ensured that a fluorescent lamp reaching its end of life can be detected.

Another object of the present invention is to prevent occurrence of an abnormal operation of the oscillation circuit on account of low voltage supplied to the oscillation circuit.

Accordingly, the control apparatus for a fluorescent lamp of the present invention is arranged to have an oscillation circuit connected to a power supply circuit, a fluorescent lamp, and an output circuit for applying the fluorescent lamp with a voltage at a frequency based on an output frequency of the oscillation circuit. The control apparatus of the fluorescent lamp has a low-voltage detection circuit supplied with an output voltage based on a power supply in common with the power supply for the power supply circuit and causing the oscillation circuit to stop its oscillating operation when the output voltage becomes lower than a predetermined value.

According to the control apparatus of fluorescent lamp of the present invention, when the supply voltage of the power supply circuit for the oscillation circuit descends for some reason or other leading to a descent of the output voltage input to the low-voltage detection circuit, the low-voltage detection circuit disables the oscillating operation of the oscillation circuit upon receipt of the output voltage lower than a predetermined value. Accordingly, abnormal operation of the oscillation circuit on account of low voltage supplied thereto can be prevented from occurring.

BRIEF DESCRIPTION OF THE DRAWINGS

FIG. 4 is a diagram showing the tube current when a fluorescent lamp is turned on;

DETAILED DESCRIPTION OF THE PREFERRED EMBODIMENT

Figure 1:
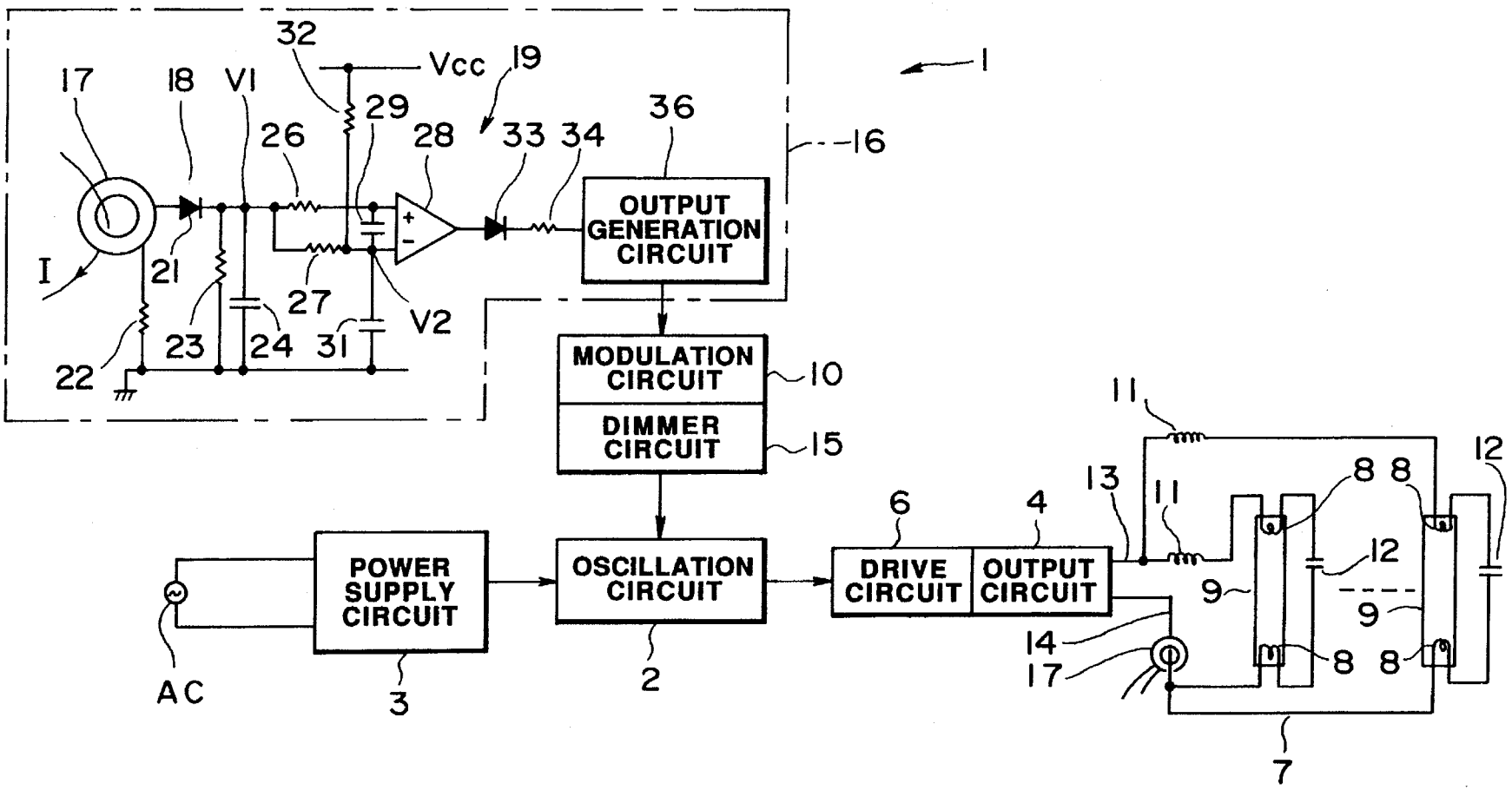
FIG. 1 is an electric circuit diagram of a control apparatus of fluorescent lamp according to the present invention.
Figure 2:
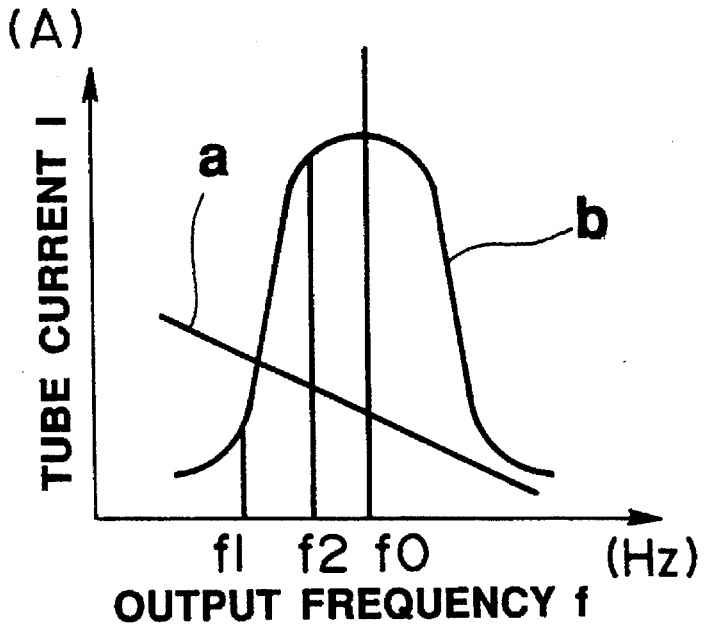
FIG. 2 is a diagram showing relationship between the output frequency of an oscillation circuit and the tube current.

An embodiment of the present invention will be described below with reference to the accompanying drawings. Referring to FIG. 1, an AC power supply AC is connected to a power supply circuit 3 for an oscillation circuit 2 and the output frequency f of the oscillation circuit 2 is input to a drive circuit 6 of an output circuit 4 formed of an FET etc. The output circuit 4 is connected with a load circuit 7 and it is adapted such that a voltage at a frequency based on the output frequency f of the oscillation circuit 2 is supplied from the output circuit 4 to the load circuit 7. The load circuit 7 is formed of several fluorescent lamps 9 each thereof having filaments 8, 8 at both ends thereof, choke coils 11 each thereof being connected in series with the filament 8, on one side, of each fluorescent lamp 9, and capacitors 12 each thereof being connected between the filaments 8, 8 of each fluorescent lamp 9. The choke coils 11 are both connected to one output line 13 of the output circuit 4 and the filaments 8 on the other side are both connected to the other output line 14 of the output circuit 4.

Figure 3:
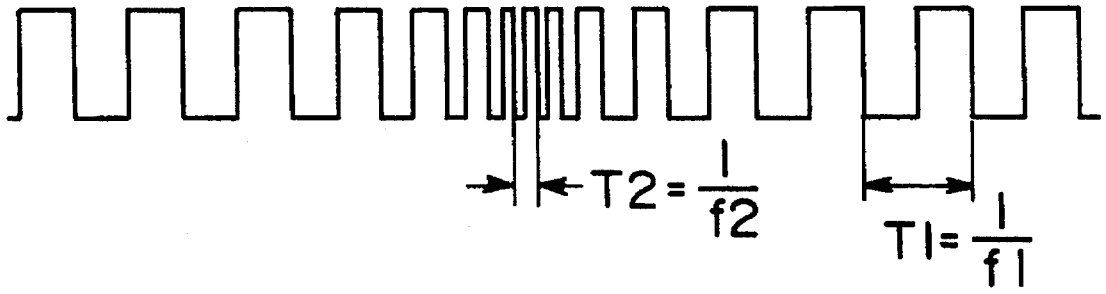
FIG. 3 is a diagram showing the output frequency of an oscillation circuit.
Figure 4:
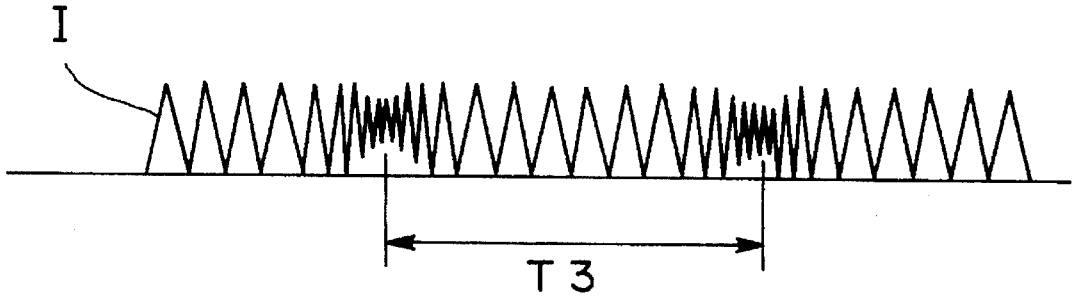

Output from a modulation circuit 10 and a dimmer circuit 15 is input to the oscillation circuit 2. In the normal state, the oscillation circuit 2, the same as described above, outputs, as the output frequency f, a fundamental frequency f1 (period: T1) of a value different from the resonant frequency f0 which is determined by the choke coil 11, the capacitor 12, and the filaments 8, 8, so that the output circuit 4 applies a voltage at the fundamental frequency f1 to the load circuit 7. Therefore, each fluorescent lamp 9 is lit, while the modulation circuit 10, as described above, modulates the output frequency f of the oscillation circuit 2 to a frequency f2 closer to the resonant frequency f0 than the fundamental frequency f1 at intervals of a predetermined period T2 (for example, 4 msec) as shown in FIG. 3. The dimmer circuit 15 is adapted to increase the output frequency f of the oscillation circuit 2 to thereby increase the impedance of the choke coil 11 so that the brightness of the fluorescent lamp 9 may be decreased within a predetermined range.

The portion enclosed by a chain line in the diagram shows a tube's end-of-life detection circuit 16. The tube's end-of-life detection circuit 16 is formed of a detection coil 17 as a tube current detection means for detecting the tube current I flowing through the output line 14 of the output circuit 4, a rectifier circuit 18 for rectifying the output voltage of the detection coil 17, and a detection circuit 19 receiving the output voltage of the rectifier circuit 18. The rectifier circuit 18 is formed of a diode 21, a capacitor 24 with a small capacitance value, connected between the forward end of the diode 21 and the ground, and resistors 22 and 23. The detection circuit 19 is formed of resistors 26 and 27 parallelly connected to one terminal of the capacitor 24, an operational amplifier 28 having its positive input terminal and negative input terminal connected with the resistors 26 and 27, respectively, a capacitor 29 connected between both the input terminals, a capacitor 31 with a large capacitance value connected between the negative input terminal and the ground, a resistor 32 connected between the negative input terminal and a power source VCC, a diode 33 and a resistor 34 connected with the output of the operational amplifier 28, and an output generation circuit 36 connected with the resistor 34, the output of the output generation circuit 36 being connected with the above described modulation circuit 10 and dimmer circuit 15.

Figure 6:
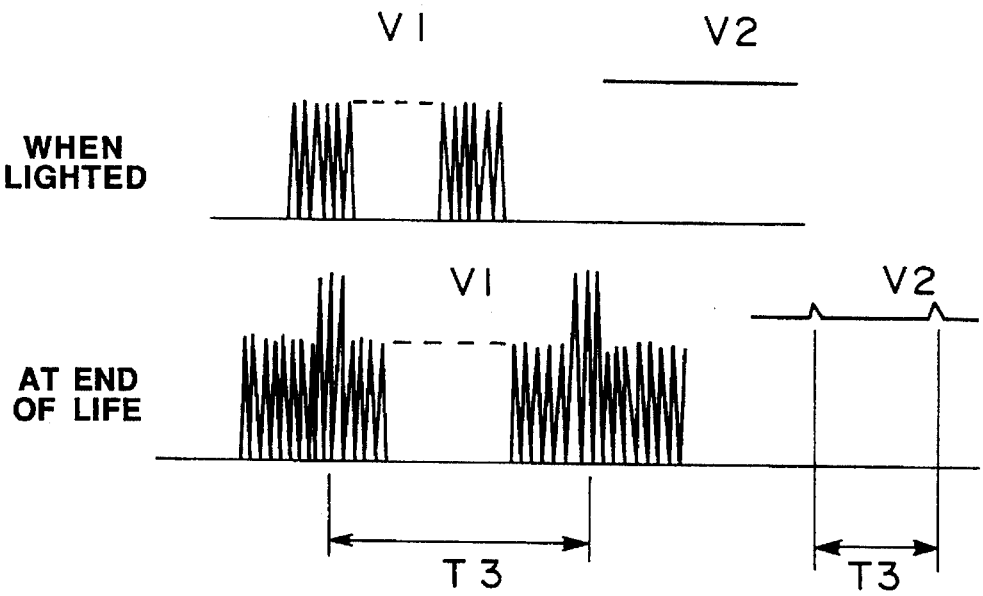
FIG. 6 is a diagram showing the terminal voltage of a capacitor of a rectifier circuit input to the positive input terminal of an operational amplifier and the terminal voltage of the capacitor input to the negative input terminal of the operational amplifier.

Operation of the circuit of FIG. 1 will be described below. A tube current I flowing through the load circuit 7 causes a voltage to be induced on the secondary side of the detection coil 17. The induced voltage is rectified by the diode 21 of the rectifier circuit 18 and smoothed by the capacitor 24. The terminal voltage V1 of the capacitor 24 when the lamp is lit is shown in the upper portion of FIG. 6. Although the voltage V1 is depicted in the diagram so as to have short-duration waveforms but, in reality, it has smoothed waveforms between the peaks due to the smoothing action of the capacitor 24. The voltage V1 is input to the operational amplifier 28 through the resistors 26 and 27. At this time, the voltage V1 is smoothed at the time constant determined by the resistor 27 and the capacitor 31 and input to the negative input terminal of the operational amplifier, while it is passed through the resistor 26 and input to the positive input terminal. Here, the terminal voltage V2 of the capacitor 31 is pulled up by the resistor 32 so that the voltages V1 and V2 have a mutual relationship as shown in the upper portion of FIG. 6. Accordingly, when every fluorescent lamp 9 is lit, the output of the operational amplifier 28 is "L".

Figure 5:
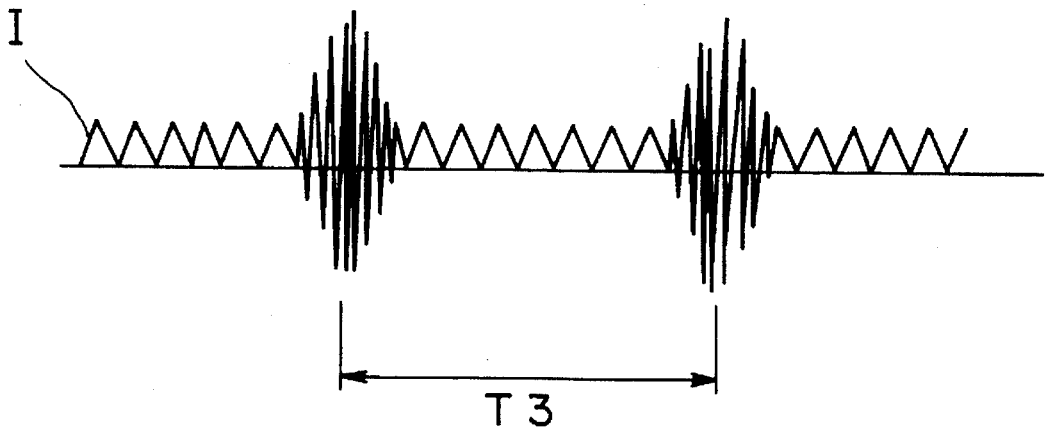
FIG. 5 is a diagram showing the tube current when a fluorescent lamp is extinguished.

On the other hand, when any of the fluorescent lamps 9 reaches its end of life a high tube current I as shown in FIG. 5 flows through the load circuit 7 upon execution of the above described modulation by the modulation circuit 10. This tube current is detected by the detection coil 17, so that the terminal voltage V1 of the capacitor 24 comes to exhibit a pulsating rise at intervals of the period T3 as shown in the lower portion of FIG. 6. However, since the capacitor 31 has large capacitance, the rise of the voltage V2 due to increase in the voltage V1 is small. Accordingly, at the time when the modulation is performed, the voltage (V1) at the positive input terminal of the operational amplifier 28 becomes larger than the voltage (V2) at the negative input terminal and, hence, a "H" pulse at the period T3 comes to be input to the output generation circuit 36. The output generation circuit 36 counts the "H" pulses for example 250 times (corresponding to a time of approximately 1 sec.) and then generates a prohibit output to the modulation circuit 10 and the dimmer circuit 15. Upon receipt of this prohibit output, the modulation circuit 10 stops the above described modulating operation at the period T3. Also the dimmer circuit 15, upon receipt of the prohibit output, stops the dimming operation so that the output frequency f of the oscillation circuit 2 is restored to the fundamental frequency f1.

Thereafter, the voltage of the fundamental frequency f1 free from modulation is applied to the load circuit 7 and, hence, normal fluorescent lamps 9 continue to be lit with ordinary brightness, while the fluorescent lamp 9 at the end of life is made unable to give out light again and kept put out. Thus, the problem of a large current flowing through the load circuit 7 can be solved so that the circuit components such as choke coil 11 are prevented from being damaged and also the occurrence of the repeated going on and out of the fluorescent lamp 9 reaching its end of life can be prevented and the problem of deterioration in the illuminating effect can be solved. The purpose of the counting made in the output generation circuit 36 is to keep itself from operating in the event of generation of the large tube current I for a short period of time when a fluorescent lamp 9 in the normal state is put out. Instead of the counting of the pulses practiced in the above embodiment, it may be arranged such that a delay time of 1 second after generation of a pulse is provided by a time constant circuit and the aforesaid operation is made thereafter.

Figure 7:
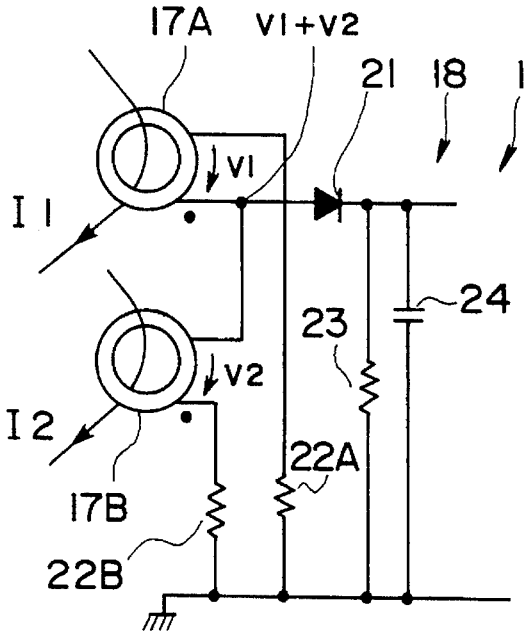
FIG. 7 is an electric circuit diagram of a control circuit for a pair of fluorescent lamps according to the present invention where two detection coils are used.

In an apparatus having a large number of fluorescent lamps 9 to be lit, the tube current I becomes great at the time when the lamps are normally lit and, hence, the detection of an abnormal tube current caused by the above described modulation becomes difficult. Therefore, as shown in FIG. 7, two detection coils 17A and 17B may be used to be provided for each of two load circuits 7, 7, each thereof having a large number of fluorescent lamps 9 (a special case where each load circuit 7 is formed of one fluorescent lamp 9 may be included). In such an arrangement, the secondary sides of the detection coils 17A and 17B are connected such that their output voltages v1 and v2 have characteristics reverse to each other and the sum voltage v1+v2 is input to the diode 21 of the rectifier circuit 18 (the rectifier circuit 18 uses, as the resistor 22 in the case of FIG. 1, resistors 22A and 22B). The circuit configuration subsequent to the rectifier circuit 18 is the same as that in FIG. 1.

In the state of the fluorescent lamps normally lit, virtually equal tube currents I1 and I2 flow through the load circuits 7, 7 so that the voltages v1 and v2 detected by the detection coils 17A and 17B become equal and, therefore, the detected voltages are canceled with each other to make the voltage v1+v2 input to the diode 21 zero. Accordingly, the output of the subsequent operational amplifier 28 does not go "H". When a fluorescent lamp 9 of any of the load circuits 7 reaches its end of life, and if for example the tube current I1 becomes great as described above at the time when the modulation is performed by the modulation circuit 10, then the voltage v1+v2 becomes great. Thereafter, the same as in the case of FIG. 1, the operational amplifier 28 generates a "H" pulse at the period T3 to cause the output generation circuit 36 to operate. Since it hardly occurs that fluorescent lamps 9 of both load circuits 7, 7 simultaneously reach their end of life, practically no problem arises from it.

Figure 8:
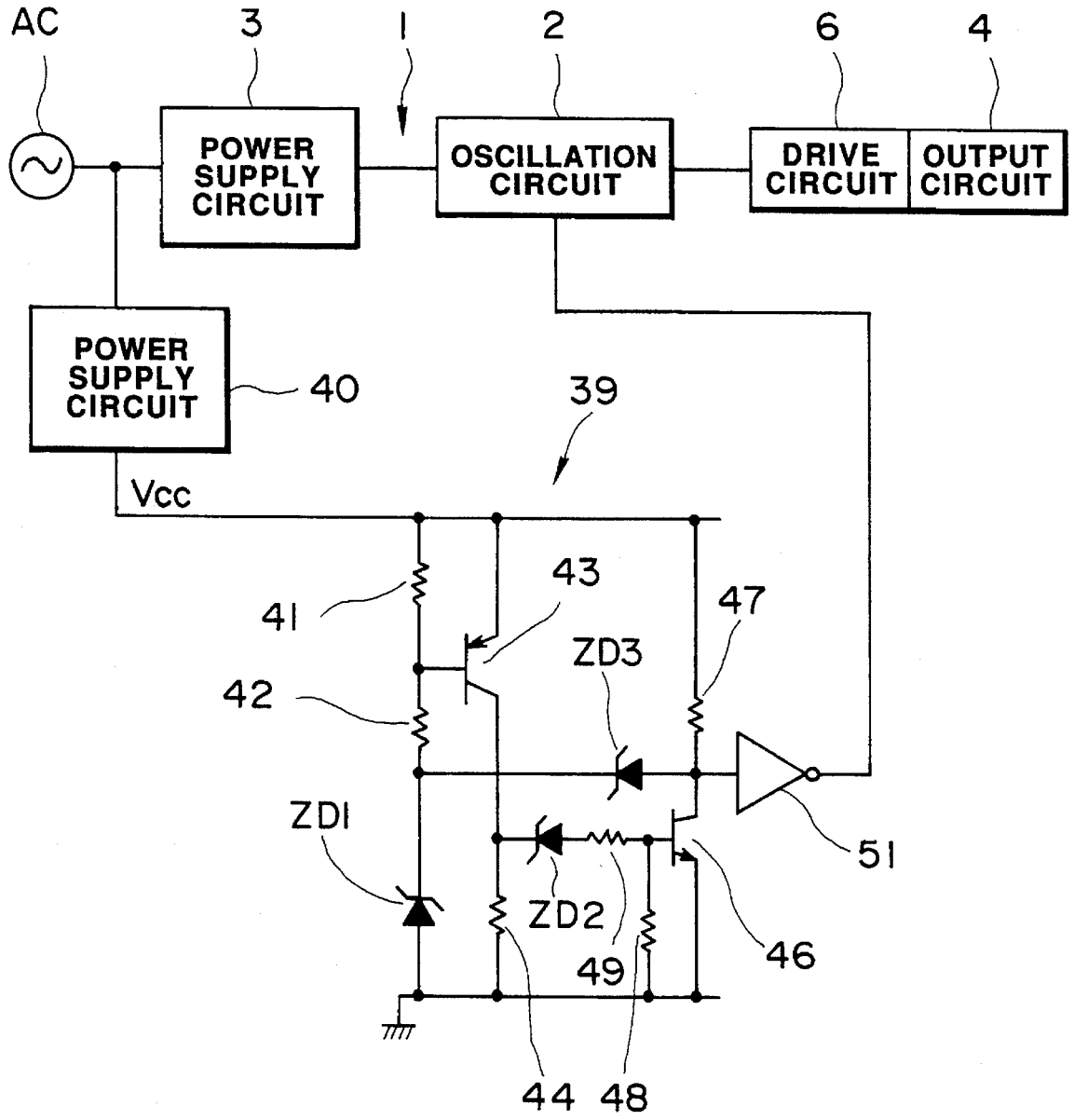
FIG. 8 is an electric circuit diagram of a low-voltage detection circuit of the present invention.

Referring now to FIG. 8, a low-voltage detection circuit 39 of a control apparatus 1 of fluorescent lamps causing the oscillation circuit 2 to stop its operation when the power supply voltage is low. Component parts in FIG. 8 corresponding to those in FIG. 1 are denoted by like reference numerals and, further, it is assumed that a similar load circuit 7 is arranged in the stage subsequent to the output circuit 4. To the AC power supply, with which the power supply circuit 3 for the oscillation circuit 2 is connected, is also connected a power supply circuit 40 outputting a DC power supply VCC. Between the power supply VCC and the ground, there is connected a series circuit of resistors 41 and 42 and a zener diode D1. The emitter of a transistor 43 is connected to the power supply VCC, the base is connected to the junction point of the resistors 41 and 42, and the collector is grounded through a resistor 44. The collector of a transistor 46 is connected to the power supply VCC through a resistor 47 and the emitter is grounded. The base of the transistor 46 is grounded through a resistor 48 and, between the base and the resistor 44, there is connected a series circuit of a zener diode ZD2 and a resistor 49. The voltage at the junction point of the collector of the transistor 46 and the resistor 47 is input to an inverter 51 and the output of the inverter 51 is input to the oscillation circuit 2. Between the junction point of the zener diode ZD1 and the resistor 42 and the inverter 51, there is connected a zener diode ZD3, and the relative voltage condition of the zener diode ZD3 and the zener diode ZD1 is set to be ZD3<ZD1.

Operation of the circuit will now be described. When the power supply AC is applied and the breakdown voltage of the zener diode ZD1 is reached, current starts to flow through the resistors 41 and 42 and the zener diode ZD1 and, thereby, the transistor 43 is rendered conductive. When the transistor 43 becomes conductive, voltage is applied to the zener diode ZD2 and, when the voltage reaches its breakdown voltage, current flows therethrough and, thereby, the transistor 46 is rendered conductive. As the transistor 46 becomes conductive, the input voltage to the inverter 51 is changed from "H" to "L" and, hence, the output thereof becomes "H". The oscillation circuit 2 is so arranged that it performs the oscillating operation when the output of the inverter 51 is "H". As the transistor 46 conducts current, the base potential of the transistor 43 is lowered from the voltage on the zener diode ZD1 to the voltage on the zener diode ZD3 and, because of hysteresis, the transistor 43 continues to be conducting current in a stabilized manner.

On the other hand, when the power supply VCC, upon application of the AC power supply AC, does not rise to the breakdown voltage of the zener diode ZD1, or when the AC power supply AC, after being applied, is lowered by some reason or other, so that the power supply VCC becomes lower than the breakdown voltage of the zener diode ZD3, no currents come to flow through the zener diodes ZD1 and ZD3 and, hence, the transistor 43 is rendered nonconductive. Accordingly, the transistor 46 also becomes nonconductive and, as a result, the output of the inverter 51 becomes "L". The oscillation circuit 2 stops its oscillating operation when the output of the inverter 51 is "L". Thus, the abnormal operation of the oscillation circuit 2 in the event of low-voltage power supply can be prevented and damage to circuit components can be prevented.

According to the fluorescent lamp control apparatus of the present invention as described above in detail, it is made possible to detect the end-of-life state of a fluorescent lamp and, thereby, abnormal operation of the modulation circuit or dimming operation of the dimmer circuit is prohibited and, hence, it becomes possible to prevent occurrence of damage to circuit components due to an abnormal current flowing through the load circuit when a fluorescent lamp reaches its end of life or occurrence of a bad illuminating effect due to repeated going on and off of a fluorescent lamp at its end of life.

Especially in the arrangement of FIG. 7, a first and a second current detection means are used and they are connected such that their outputs have reverse characteristics to each other, it is made possible to easily detect the existence of a fluorescent lamp at its end of life even when a large number of fluorescent lamps are arranged to be lit.

Further, according to the present invention, when the power supply voltage of the power supply circuit for the oscillation circuit is low, a low-voltage detection circuit stops the oscillating operation of the oscillation circuit when an output voltage input thereto becomes lower than a predetermined value. Therefore, damage and the like caused to circuit components due to an abnormal operation of the oscillation circuit following lowered voltage can be prevented from occurring.

What is claimed is:

1. A control apparatus for a load circuit formed of a fluorescent lamp provided with a filament at each end thereof, a capacitor connected to at least one of said filaments, and a choke coil connected in series with one of said filaments, said load circuit having a resonant frequency comprising:

an oscillation circuit for normally supplying said load circuit with an operating voltage at a first frequency different from said load circuit resonant frequency, means for periodically modulating for a predetermined time period the output frequency of said oscillation circuit to a second frequency closer to the resonant frequency of said load circuit than said first frequency to correspondingly change the frequency of the voltage supplied to said load circuit, and a tube end-of-life circuit comprising:

means for detecting a lamp tube current flowing through said load circuit due to the application thereto of the voltage of said second frequency during a said predetermined time period and producing an output signal related thereto, and a detection circuit receiving the output signal of said lamp tube current detecting circuit for detecting a rise in the load circuit current during the occurrence of the output voltage of said second frequency as an indication of end-of-lamp life.

2. A control apparatus for a load circuit formed of a fluorescent lamp provided with a filament at each end thereof, a capacitor connection to at least one of said filaments, and a choke coil connected in series with one of said filaments, said load circuit having a resonant frequency comprising:

an oscillation circuit for normally supplying said load circuit with an operating voltage at a first frequency different from said load circuit resonant frequency, a modulation circuit for periodically modulating for a predetermined time period the output frequency of said oscillation circuit to second a frequency closer to the resonant frequency of said load circuit than said first frequency, and a tube end-of-life circuit comprising:

current detection means for detecting the lamp tube current flowing through said load circuit due to the application thereto of the voltage of said second frequency during a said predetermined time period and producing an output signal related thereto, a rectifier circuit for rectifying the output signal of said current detection means and producing an output voltage related thereto, and a voltage detection circuit receiving the output voltage of said rectifier circuit for detecting a rise in said rectifier output voltage during the modulation of the operating voltage supplied to said load circuit and prohibiting the modulating operation of said modulation circuit when the rise of said output voltage representing a rise in the current of said load circuit has continued for a predetermined period of time.

3. A control apparatus for a load circuit formed of a fluorescent lamp provided with a filament at each end thereof, a capacitor connected to at least one of said filaments, and a choke coil connected in series with one of said filaments, said load circuit having a resonant frequency comprising:

an oscillation circuit for supplying said load circuit with an operating voltage at a first frequency different from the resonant frequency applied to said load circuit, means for periodically modulating for a predetermined time period the output frequency of said oscillation circuit to a second frequency closer to the resonant frequency of said load circuit than said first frequency, a dimmer circuit for adjusting the output frequency of the oscillation circuit for dimming said fluorescent lamp and a tube end-of-life circuit comprising:

lamp tube current detecting means for detecting a lamp tube current flowing through said load circuit due to the application thereto of the operating modulated voltage of said second frequency applied to said load circuit during a said predetermined period and producing an output signal related thereto, and a load current detection circuit receiving the output signal of said lamp tube current detecting means for detecting a rise in said load circuit current during the frequency modulation of the operating voltage to said second frequency and prohibiting the modulating operation of said oscillation circuit by said modulation means and the adjustment of said oscillation circuit by said dimmer circuit when the rise of said output signal has continued for a predetermined period of time.

4. A control apparatus for a first and a second load circuit formed of a first and a second fluorescent lamp each having a filament at each ends thereof, a capacitor connected to at least one of the filaments of each lamp, and a choke coil connected in series with one of said filaments of each fluorescent lamp, each said first and second load circuits having a respective resonant frequency comprising:

an oscillation circuit for supplying each of said load circuits with an operating voltage at a first frequency different from the respective resonant frequency of each of said first and second load circuits, means for periodically modulating for a predetermined period the output frequency of said oscillation circuit to a second frequency nearer the resonant frequency of each said load circuit than said first frequency, and a tube end-of-life circuit comprising:

first and second current detection means for respectively detecting lamp tube current flowing through each of said first and second load circuits due to the application thereto of the operating voltage as periodically modulated to said second frequency and providing respective output signals related thereto, a rectifier circuit for rectifying the sum of the output signals of said first and second current detection means to provide a voltage output, said first and second current detection means outputs being arranged to have characteristics reverse to each other, and a voltage detection circuit receiving the output voltage of said rectifier circuit for detecting a rise in said output voltage during the periodic modulation of the operating voltage to said second frequency as an indication of end-of-lamp life.

5. A control apparatus for a load circuit formed of a fluorescent lamp provided with a filament at each end thereof, a capacitor connected to as least one of said filaments, and a choke coil connected in series with one of said filaments, said load circuit having a resonant frequency comprising:

an oscillation circuit including a power supply for supplying said load circuit with an operating voltage at a first frequency different from the resonant frequency of said load circuit;

a modulation circuit for periodically modulating for a predetermined time period the output frequency of said oscillation circuit to a second frequency nearer to the resonant frequency of said load circuit than said first frequency;

a tube end-of-life circuit comprising:

current detection means for detecting a lamp tube current flowing through said load circuit due to the application thereto of the periodically modulated operating voltage and producing an output signal related thereto, a rectifier circuit for rectifying the output signal of said current detection means and providing an output voltage related thereto, a voltage detection circuit receiving the output voltage of said rectifier circuit for detecting a rise in said output voltage corresponding to a rise in lamp tube current during the periodic modulation of the operating voltage, a detection circuit power supply operated from said power supply of said oscillation circuit and providing an output voltage; and a power supply detection circuit for detecting the output voltage of said detection circuit power supply and causing said oscillation circuit to stop its oscillating operation when said output voltage of said detection circuit power supply becomes lower than a predetermined value.

* * * * *